US006532688B2

(12) United States Patent
Bouvier

(10) Patent No.: US 6,532,688 B2
(45) Date of Patent: Mar. 18, 2003

(54) LACE TIGHTENING DEVICE HAVING A POCKET FOR STORING A BLOCKING ELEMENT, AND A BOOT HAVING SUCH DEVICE

(75) Inventor: Jean-Michel Bouvier, Vallieres (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/888,640

(22) Filed: Jun. 26, 2001

(65) Prior Publication Data

US 2002/0002781 A1 Jan. 10, 2002

(30) Foreign Application Priority Data

Jun. 27, 2000 (FR) ..... 00 08349

(51) Int. Cl.[7] ..... A43C 11/12

(52) U.S. Cl. ..... 36/50.1; 36/54; 24/713.4; 24/713.9

(58) Field of Search ..... 36/50.1, 50.5, 36/136, 54; 24/712.1, 713.4, 713.9

(56) References Cited

U.S. PATENT DOCUMENTS

| | | | | | |
|---|---|---|---|---|---|
| 1,340,503 | A | * | 5/1920 | Schopper | 24/712 |
| 2,244,031 | A | * | 6/1941 | Teehan | 12/107 R |
| 3,631,613 | A | * | 1/1972 | Brettell | 36/136 |
| 4,630,383 | A | | 12/1986 | Gamm | 36/136 |
| 4,805,321 | A | * | 2/1989 | Tonkel | 36/100 |
| 5,477,593 | A | | 12/1995 | Leick | 24/712.5 |
| 5,566,474 | A | | 10/1996 | Leick et al. | 36/50.1 |
| 5,943,793 | A | * | 8/1999 | Clements | 36/50.1 |

FOREIGN PATENT DOCUMENTS

| | | |
|---|---|---|
| DE | 8810872 | 4/1989 |
| EP | 0923886 | 6/1999 |
| FR | 744906 | 4/1933 |
| FR | 2490467 | 3/1982 |
| FR | 2607678 | 6/1988 |

OTHER PUBLICATIONS

U.S. patent application No. 09/210,375 (Fellouke), filed on Dec. 14, 1998.

* cited by examiner

*Primary Examiner*—Ted Kavanaugh
(74) *Attorney, Agent, or Firm*—Greenblum & Bernstein, P.L.C.

(57) ABSTRACT

A lace device for tightening or closing an article such as a boot upper, garment, or backpack including a lace and at least two series of at least one guide for said lace, the sub-assembly constituted by the guides and the lace(s) defining a lacing zone, in the vicinity of which a blocking zone is located, in the area where the lace(s) extends from the lacing zone, the device further including a blocking element, a pocket adapted to receive the blocking element, the pocket being located in the blocking zone, and the pocket including passage(s) for the lace enabling the penetration of the lace between its exit from the lacing zone and its entry into the blocking element.

10 Claims, 4 Drawing Sheets

LACE TIGHTENING DEVICE HAVING A POCKET FOR STORING A BLOCKING ELEMENT, AND A BOOT HAVING SUCH DEVICE

CROSS-REFERENCE TO RELATED APPLICATIONS

This application is based upon French Patent Application No. 00 08349, filed Jun. 27, 2000, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a lace or string closure or tightening device. This type of system is widely used in boots, and in particular in sports boots in which the foot must be held firmly. However, lace or string tightening devices are used in many other fields, and the tightening device according to the invention can be used advantageously in the manufacture of garments, bags, travel bags, or sports bags such as backpacks.

2. Description of Background and Relevant Information

It is known in the field of boots to associate the lace with a blocking or wedging element which enables a quick tightening or loosening of the lace by avoiding the need to tie a knot. Certain lace blocking elements are particularly efficient when the tension on the lace(s) is substantial when the tightening is completed.

Generally speaking, the lace closure or tightening devices include the following elements: at least two series of guides in which each of the guides is connected to at least one of the guides of another series of guides, the linkage between two guides being made by a lace. All of the guides and the lace(s) are distributed over a bi-dimensional surface.

In the particular case of a boot, two series of guides are arranged on opposite sides of an opening or of a zone whose extension is sought to be reduced, and a lace runs through the guides. The tension on the two free ends of the lace brings the two series of guides closer together, thus adjusting the boot to the person's foot.

When an element for blocking a lace is used, each of the ends of the lace is passed therethrough, and the tightening occurs as follows: while holding the two free ends of the lace, one slides the blocking element on these ends until obtaining the desired tightening.

One of the major problems caused by the use of the blocking elements in the lacing systems or the string closure devices lies in the fact that once tightened, the wedging element naturally takes a position that is perpendicular to the bi-dimensional surface along which the tightening was performed.

In the particular case of a boot provided with a tongue, the wedging element projects from the top portion of the tongue when the boot is tightened. If the lacing involved is an external lacing, the projection of the blocking element, which is a technical and functional piece, modifies the overall design of the boot and is not easily integrated into the contour of the boot. It is also necessary to store the lace strands coming out of the blocking element.

To overcome this problem, it is known to provide a pocket in which the blocking element is inserted after the tightening. This solution requires an additional operation which the user often does not care to carry out.

If the lacing involved is an internal lacing, i.e., it is covered by the outer boot upper, the problem posed by the projection of the wedging element is not aesthetic but functional. Indeed, before the outer upper can be closed, it is necessary to lay the blocking element flat against the tongue, otherwise the user win feel a discomfort caused by the penetration of the blocking element into the tongue when the outer upper presses on the blocking element. Furthermore, the closure of the outer upper cannot be optimum.

Such problems are found in cross country ski boots, alpine ski boots, or snowboard boots.

SUMMARY OF THE INVENTION

An object of the invention is to overcome the aforementioned disadvantages, and in particular to provide a lace tightening or closure device that uses a blocking element ensuring an adequate positioning thereof, without it being necessary for the user to perform any operation other than tightening the device.

To this end, the invention relates to a lace device for tightening or closing a portion of a boot upper, garment, or bag, including at least two series each having at least one guide and at least one lace. The sub-assembly constituted by the guides and the lace(s) defines a lacing zone, in the vicinity of which a blocking zone is located, in the area where the lace(s) comes out of the lacing zone. The device further includes a blocking element, a pocket adapted to receive the blocking element, wherein the pocket is located in the blocking zone, and wherein the pocket includes a passage for the lace enabling the penetration of the lace between its exit from the lacing zone and its entry into the blocking element.

The guides are arranged on both sides of the longitudinal opening of the upper of a boot, and the pocket is provided on a tongue.

The pocket includes an outer wall fixed on the tongue.

The outer wall of the pocket includes a lower portion in which are arranged the passage for the lace and an upper portion adapted to receive the blocking element when the device if tightened.

In one preferred embodiment of the invention, the upper portion of the pocket is made of an elastic material making it possible to reach the push button of the blocking element when the latter is inserted into the pocket, on the one hand, and to house the free strands of the lace, on the other hand. Thus, the loop formed by the free strands of the lace is completely safe from an accidental hooking.

BRIEF DESCRIPTION OF DRAWINGS

The present invention also relates to the characteristics which will become apparent from the description that follows, with reference to the annexed drawings showing, by way of non-limiting examples, several embodiments of the invention, and in which.

DETAILED DESCRIPTION OF THE INVENTION

Figure 1:
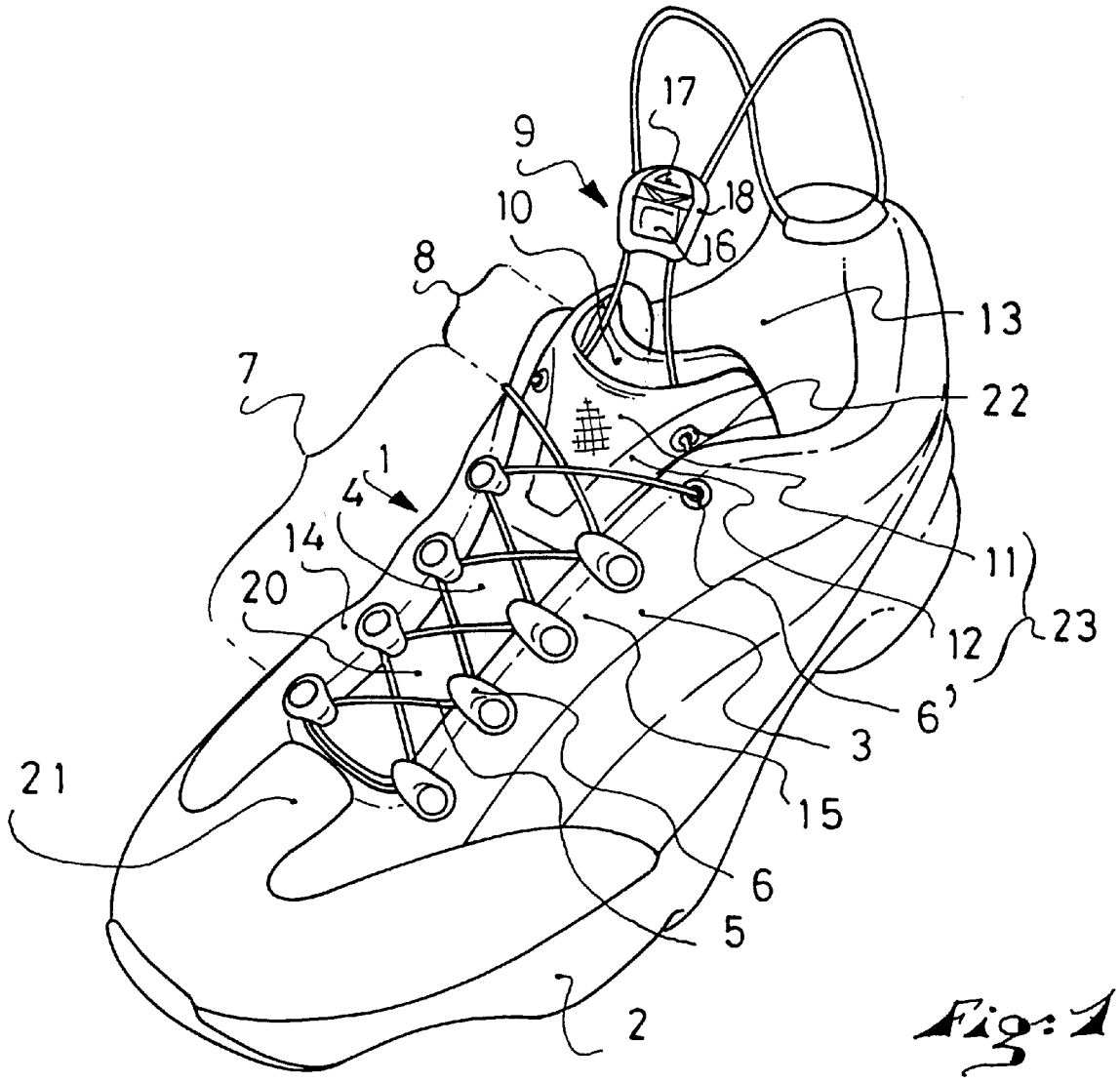
FIG. 1 is a perspective view of a boot using a device according to a first embodiment of the invention showing the tightening of the boot.

FIG. 1 shows a boot 1 that includes a sole 2 and an upper 3. An upper opening provided in the upper enables the introduction of the user's foot. This upper opening 13 is extended by a longitudinal opening 20 whose role is to facilitate the introduction of the user's foot, on the one hand, and to enable the precise adjustment of the inner volume of the boot 1 to the volume of the user's foot.

The sides of the longitudinal opening 20 are defined by the lateral side 15 and the medial side 14 of the upper. The upper 3 is also equipped with an internal tongue 4 fixed in the area of the base of the longitudinal opening 20, i.e., in the vicinity of the end-piece 21 of the boot 1. Two series of five guides 6 are arranged on both sides of the longitudinal opening, fixed on the edges of the lateral side and of the medial side, respectively.

In each of the series of guides, the four lower guides are of the hook type, whereas the upper guide, i.e., the last guide 6', is of the eyelet type. The lace 5 runs through all of the guides, such that each of the guides, except one of one of the series of guides is connected to two guides of the other series by means of the lace. The assembly constituted of the guide and of the lace is called the lacing zone. The traction of the lace upon exit from this zone makes it possible to reduce the inner volume of the boot by bringing the two series of guides closer together. The zone which, for the lace, immediately follows the lacing zone, is termed the blocking zone.

A pocket 10 is located in this latter zone, which is arranged on the inner tongue. This pocket 10 is obtained by sewing an outer wall on the upper end of the inner tongue. The outer wall 23 is composed of a lower portion 12 made of a non-extensible material and through which eyelets 22 are provided, and an upper portion 11 made of an extensible or elastic material, which can elastically increase the size of the upper opening of the pocket as the blocking element is positioned therein, as explained below.

The strands of the lace 5 extend from the guides 6' of the lacing zone through the passages comprised by the eyelets 22 of the pocket, whereby the strands of the lace enter the pocket 10. After the passage of the lace 5 in the pocket 10, the lace extends through the blocking element 9. Various types of blocking elements can be used, according to a preferred embodiment. The blocking element 9 includes a body 18 equipped with an abutment 17. A movable roller, whose movement is controlled outside by a push-button, is located within the body.

The functioning of the device according to the invention will now be described.

In the initial state, the lateral and medial sides are spaced apart as much as possible, and most of the length of the lace is in the lacing zone.

After inserting his foot in the boot, the user begins tightening by pulling on the loop formed by the two strands of the lace with one hand, and by pushing the blocking element downwardly. Progressively, the eyelets 22 of the pocket move toward the last guides 6' of each series of guides of the lacing zone, which results in positioning the tongue both longitudinally and laterally. When tightening is completed, the blocking element 9 has reached its lowermost position, i.e., in the blocking zone, and is located in the pocket. Thereby, the blocking element is automatically inserted in the pocket through the upper opening of the pocket as the lace is tightened. By means of the aforementioned structure, including the relative positions thereof, including the lace, blocking element, guides, eyelets, and the pocket, the invention includes means for automatically inserting the blocking element into the pocket as the lace is tightened.

Figure 2:
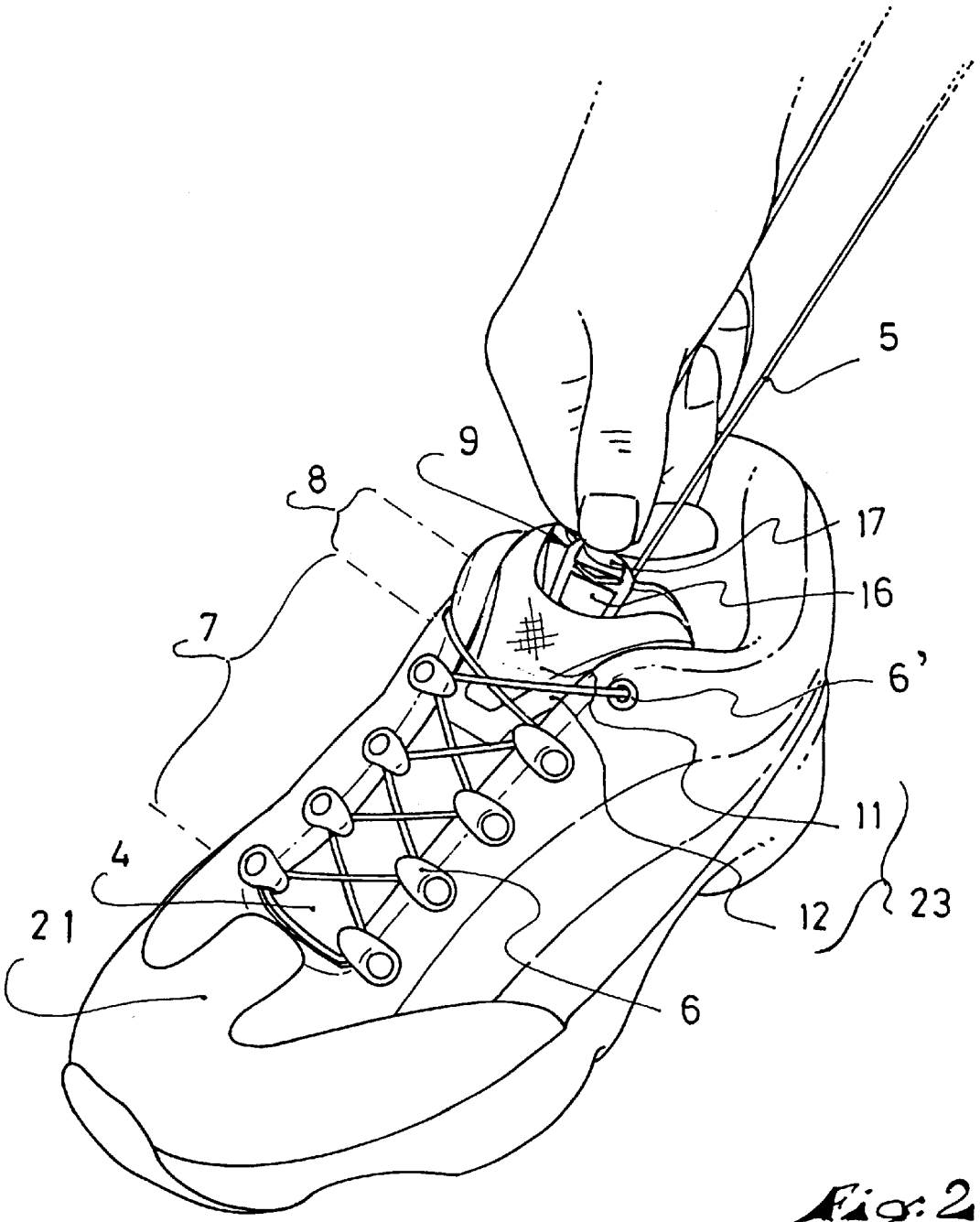
FIG. 2 is a perspective view of the boot described in FIG. 1, after the tightening thereof.

The final state is shown in FIG. 2. It is also noted that when tightening is completed, the eyelets 22 of the pocket have been brought closer to the upper guides of the lacing zone 7 until the latter are superimposed. Thus, a very precise position of the tongue, and in particular its centering, is obtained.

To loosen the boot, the user presses the push-button 16, which is located on the blocking element, with a finger. Since this push-button is then in the pocket, it is necessary to lift the outer wall of the pocket to have access thereto. The pressure exerted by the finger on the push-button displaces the roller and releases the lace, thus enabling the blocking element to slide along the two lace strands. The user only needs to pull on the tongue so as to space the lateral and medial sides apart so that the foot can be extracted more easily.

Figure 3:
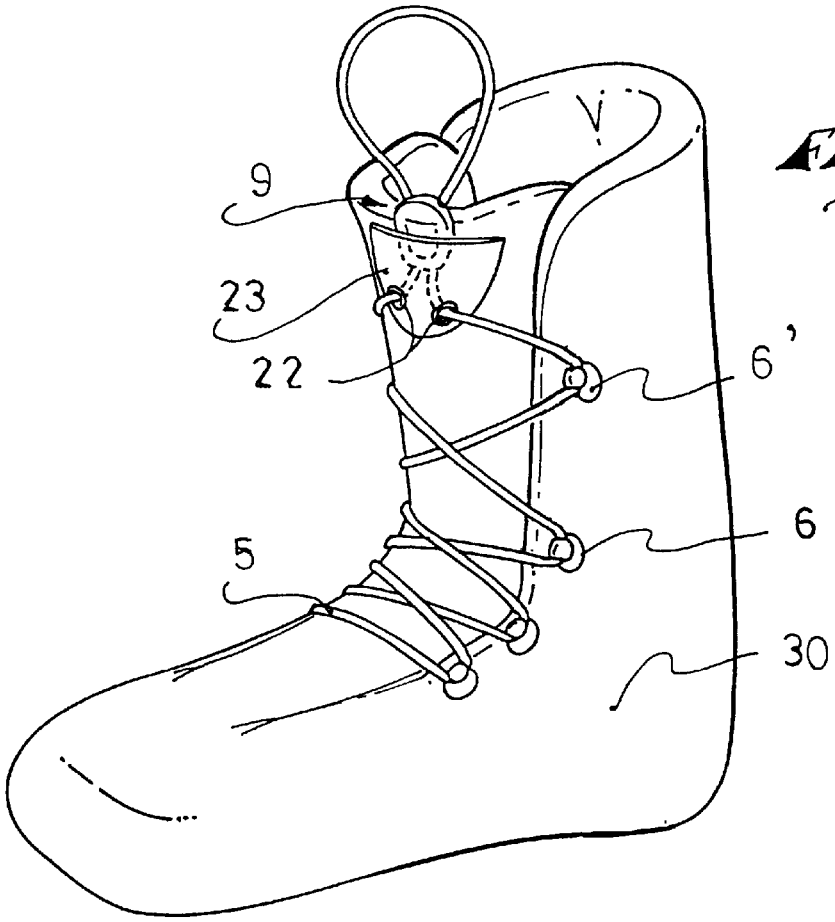
FIG. 3 shows a perspective view of a second embodiment of the invention.

FIG. 3 shows a second embodiment of the invention in which the tightening device ensures the internal tightening of a liner. This liner 30 is then inserted in an outer upper, which itself can be tightened by a lace or by any other tightening device.

Similar to the preceding embodiment, each of the sides of the upper of the liner is equipped with a series of guides 6 through which a lace 5 runs. A pocket is provided in the upper zone of the tongue, in the area of the blocking zone. This pocket is made by means of an outer wall 23 which includes at its base two eyelets 22 through which the two lace strands penetrate, enabling the lace to enter into the pocket 10. The pocket is adapted to receive the blocking element 9 when the device is in the tightened state. FIG. 3 shows a liner in this state, and it is seen that contrary to the first embodiment in the closed position, the eyelets 22 are not exactly adjacent the last of the guides 6' of each series of guides. Thus, during the closure of the liner, the user can select the exact position that he wishes the tongue to take. If he desires to center the latter precisely, he pushes and places the blocking element in the central position. If, on the other hand, he wishes to offset the tongue on either side, he only needs to push and place the blocking element accordingly.

Figure 4:
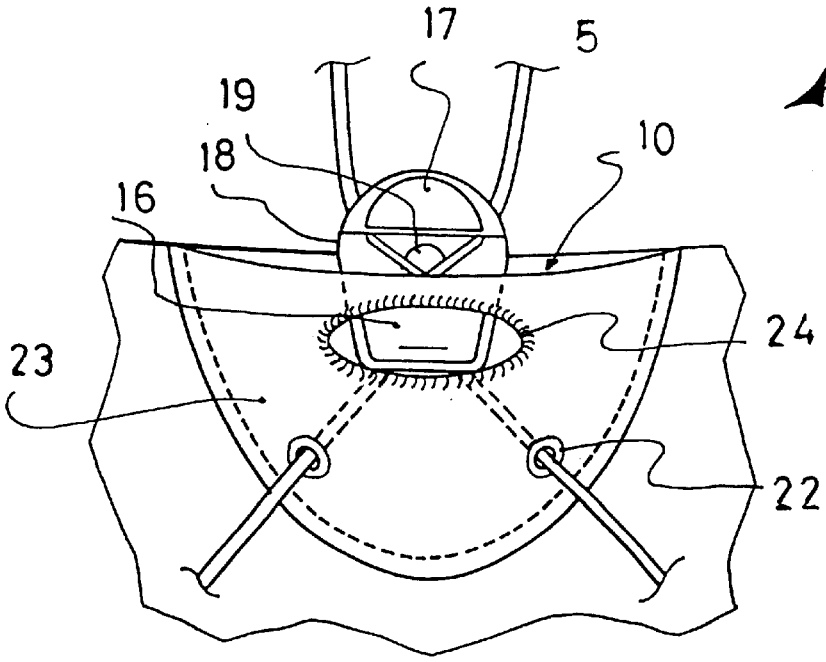
FIG. 4 is a partial view showing the blocking zone according to a third embodiment of the invention.

FIG. 4 shows a partial view of a third embodiment of the invention. The outer wall 23 of the pocket 10 therein is constituted of a single piece sewn in the blocking zone. Eyelets 22 are positioned on this outer wall 23, and a window 24 is pierced in this wall 23 so as to facilitate the access to the push-button 16 when the blocking element is inserted in the pocket, and the lace is tightened. The outer wall of the pocket is a piece of fabric or flexible plastic in which the eyelets and the window are cut and then stitched.

Figure 5:
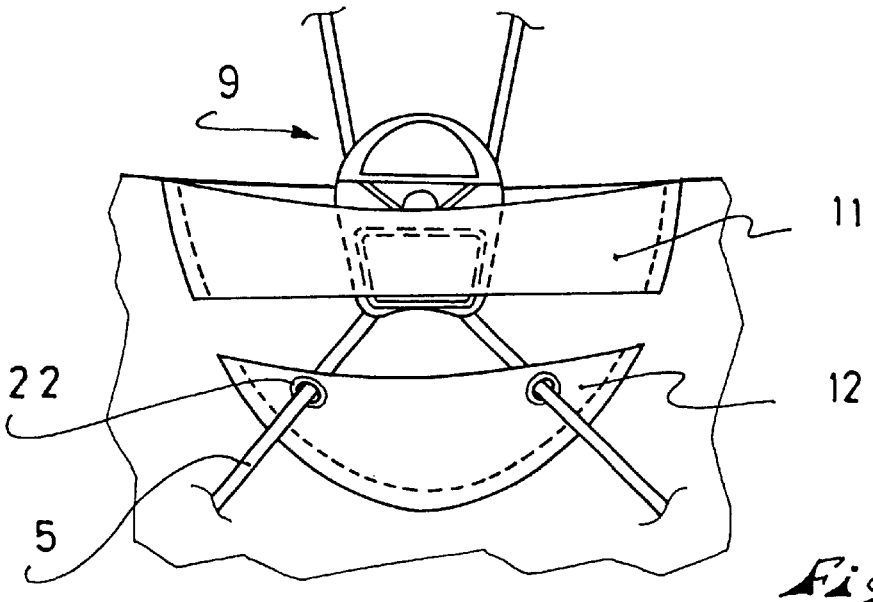
FIG. 5 is a partial view showing the pocket according to a fourth embodiment of the invention.

In the embodiment of the invention, a partial view of which is shown in FIG. 5, the outer wall of the pocket includes two distinct pieces. The eyelets 22 are arranged in the lower portion 12, whereas the upper portion 11 is constituted of a band adapted to receive and maintain the blocking element 9 in place when the tightening device is tightened.

Figure 6:
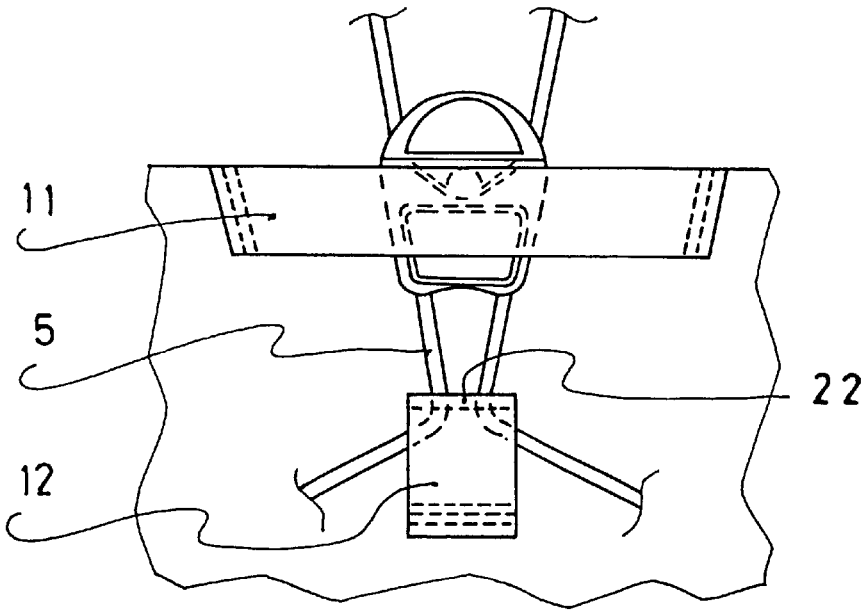
FIG. 6 is a partial view showing the blocking element according to a fifth embodiment of the invention.

The embodiment of the invention described in FIG. 6 is only a variation of the preceding embodiment. The lower portion 12 of the outer wall of the pocket is in the form of a ribbon folded in two and sewn by its two ends in the area of the blocking zone, and in the fold of which an eyelet 22 is provided. The two lace strands pass through this single eyelet before penetrating into the blocking element.

The invention is not limited to the few particular embodiments described here by way of non-limiting examples, and it can be envisioned to equip any tightening device using a lace and a lace blocking element of a device according to the invention, for tightening a garment or a bag, such as a backpack, for example.

NOMENCLATURE

1—Boot
2—Sole
3—Upper
4—Tongue
5—Lace
6—Guide
6'—Last guide
7—Lacing zone
8—Blocking zone
9—Blocking element
10—Pocket
11—Upper portion
12—Lower portion
13—Upper opening
14—Medial side
15—Lateral side
16—Push-button
17—Abutment
18—Body
19—Friction roller
20—Longitudinal opening
21—End-piece
22—Eyelet
23—Outer wall
24—Window
30—Liner

What is claimed is:

1. A lace device for tightening or closing an article, said lace device comprising:

at least two series of guides, each of said series comprising at least one guide;

a lace to be guided by said two series of guides, said two series of guides and said lace defining a lacing zone;

a blocking zone located in a vicinity of said lacing zone where said lace extends from said lacing zone;

a blocking element in said blocking zone for tightening said lace in said lacing zone;

a pocket having an opening through which said blocking element is adapted to pass, said pocket including at least one passage for said lace enabling said lace to enter said pocket between exiting from said lacing zone and entering into said blocking element, said at least one passage being distinct from said opening.

2. A lace device according to claim 1, in combination with a boot upper, said boot upper having a tongue, wherein said guides are arranged on both sides of a longitudinal opening of said boot upper, and wherein said pocket is positioned on said tongue.

3. A lace device according to claim 2, wherein said pocket includes an outer wall fixed on said tongue.

4. A lace device according to claim 3, wherein said outer wall of said pocket includes a lower portion in which said at least one passage for said lace is arranged and an upper portion adapted to receive said blocking element when the device is tightened.

5. A lace device according to claim 3, wherein said outer wall of said pocket includes a window.

6. A lace device according to claim 4, wherein said upper portion of said outer wall includes an elastic material to increase the pocket opening size.

7. A lace device according to claim 1, wherein the device constitutes an internal tightening system of a sports boot.

8. A lace device according to claim 4, wherein said lower and upper portions of said pocket are distinct.

9. A lace device for tightening or closing an article, said lace device comprising:

at least two series of guides, each of said series comprising at least a plurality of guides;

a lace guided by said two series of guides, said two series of guides and said lace defining a lacing zone;

a blocking zone located in a vicinity of said lacing zone where said lace extends from said lacing zone;

a blocking element in said blocking zone for tightening said lace in said lacing zone;

a pocket having an opening and a size adapted to receive said blocking element, said pocket being located in said blocking zone; and means for automatically inserting said blocking element into said pocket as said lace is tightened, said means comprising at least one passage in a wall of said pocket, said lace extending from said lacing zone through said at least one passage and into said blocking element.

10. A sport boot comprising:

a sole;

an upper extending upwardly from said sole, said upper including a tongue, at least two series of lace guides arranged on opposite sides of a longitudinal opening for receiving a foot of a wearer of the boot, each of said series comprising at least a plurality of guides; and a lace device for tightening said upper on the foot of the wearer, said lace device comprising:

a lace guided by said two series of guides, said two series of guides and said lace defining a lacing zone;

a blocking zone located in a vicinity of said lacing zone where said lace extends from said lacing zone;

a blocking element in said blocking zone for tightening said lace in said lacing zone;

a pocket having an opening and a size adapted to receive said blocking element, said pocket being located in said blocking zone; and means for automatically inserting said blocking element into said pocket as said lace is tightened, said means comprising at least one passage in a wall of said pocket, said lace extending from said lacing zone through said at least one passage and into said blocking element.

* * * * *